US007257975B1

(12) United States Patent
Stauffacher et al.

(10) Patent No.: US 7,257,975 B1
(45) Date of Patent: Aug. 21, 2007

(54) FLANGE TURNING PROCESS/MACHINE

(75) Inventors: Glenn Stauffacher, Pequot Lake, MN (US); Jerome J. Myers, Maple Grove, MN (US)

(73) Assignee: Sheet Metal Connectors, Inc., Minneapolis, MN (US)

( * ) Notice: Subject to any disclaimer, the term of this patent is extended or adjusted under 35 U.S.C. 154(b) by 160 days.

(21) Appl. No.: 10/925,386

(22) Filed: Aug. 25, 2004

(51) Int. Cl.
*B21D 3/02* (2006.01)

(52) U.S. Cl. ..... 72/117; 72/120; 72/125

(58) Field of Classification Search ..... 72/107, 72/110, 115, 117, 120, 122, 123, 124, 125, 72/126, 370.06, 370.08
See application file for complete search history.

(56) References Cited

U.S. PATENT DOCUMENTS 3,011,539 A * 12/1961 Henrickson ..... 72/117
3,290,914 A * 12/1966 Vaill et al. ..... 72/117
3,477,265 A * 11/1969 Szitar, Jr. ..... 72/117
3,797,088 A * 3/1974 Stettler et al. ..... 29/894.35
4,008,592 A 2/1977 Hall et al.
4,779,441 A * 10/1988 Pringle ..... 72/316
5,956,987 A 9/1999 Anthoine

FOREIGN PATENT DOCUMENTS

CA 350264 5/1935
CA 351425 7/1935
CA 1076889 5/1980

OTHER PUBLICATIONS

Website at www.t-drill.fi/ entitled "T-DRILL F-200 and F-400, F-200 and F-400 Flanging Machines"; this website was published more than one year prior to the filing date of the present application for patent for the above-indentified invention.

* cited by examiner

*Primary Examiner*—Ed Tolan
(74) *Attorney, Agent, or Firm*—Kinney & Lange, P.A.

(57) ABSTRACT

A spiral pipe has an integrated radial flange. A machine for forming such a flange comprises a rotor which rotates and a flange roller mechanism connected to the rotor via slides. As the rotor rotates, the flange roller mechanism moves radially via the slides to form an integrated flange on an end portion of the spiral pipe.

26 Claims, 12 Drawing Sheets

FLANGE TURNING PROCESS/MACHINE

CROSS-REFERENCE TO RELATED APPLICATION(S)

None.

BACKGROUND OF THE INVENTION

Spiral pipe is used in a variety of duct work applications. Spiral pipe is typically manufactured from galvanized steel, and is available in a wide variety of diameters, ranging from 3-inches to 80-inches. Similarly, spiral pipe is available in a wide wall thickness, ranging from 26-gauge up through 16-gauge. Lastly, spiral pipe may come in a variety of lengths, ranging from 1-foot to 20-feet, with 10-feet lengths being standard.

Spiral pipe is made by forming a coil of metal into a rigid steal tube with a four-ply spiral lock seam. Though it is common in the art to refer to this type of pipe as "spiral pipe" pipe, the seam of the pipe extends helically along the length of the pipe. Forming the spiral pipe in this way results in the pipe having a resistance to crushing approximately 2½times that of a longitudinally box seamed or longitudinally welded pipe. In addition, the spiral pipe has a smooth interior for low friction loss because the grooved seam is entirely on the outside. This low friction loss inside the spiral pipe allows the air to flow smoothly or "tumble" down the tube, increasing the efficiency of air flow through the spiral pipe.

Pipe-to-pipe connections are typically made using a fitting size coupling that slips inside the mating pipe sections. A stop bead runs around the middle of the coupling to center the coupling between the two pipe sections. The coupling is then secured by installing sheet metal screws through the outer shell of the duct a half inch from the stop bead. This method is time-consuming, increases the labor lost, and requires the tools and space necessary to allow the coupling to be attached to the spiral pipes. Further, the resulting connection created at the coupling may reduce the efficiency of the air flow through the spiral pipes. Specifically, the air does not flow efficiently through the pipes due to the coupling, the screws attaching the coupling to the spiral pipes, and any imperfections in the fit between the coupling and the two lengths of spiral pipe.

As an alternative to a coupling inserted between two pipes, it is possible to fit two lengths of pipe together using a flange integrally formed on the end of each pipe. However, it has proven especially difficult to manufacture spiral pipe having an integrated flange at the end of the spiral pipe. A major challenge in forming a flange at the end of a spiral pipe is the four-ply seam which extends helically along the length of the pipe. It is difficult to bend the four-ply seam area of the spiral pipe to form the flange without damaging the spiral pipe. Often, the spiral pipe will break or crimp when attempting to form a flange at the location of the four-ply spiral seam.

Thus, there is a need in the art for a spiral pipe having an integrated flange located at the end of the length of pipe. Similarly, there is a need in the art for a method of manufacturing a spiral pipe having an integrated flange.

BRIEF SUMMARY OF THE INVENTION

The present invention is a spiral pipe formed with an integrated flange, as well as a machine for forming an integrated flange on the spiral pipe. The machine comprises a mandrel and four jaws for holding the spiral pipe against the mandrel. The machine further comprises a rotor plate which is configured to be rotated. Mounted on the rotor plate are three flange turning rollers. The flange turning rollers are connected to the rotor plate via slides. The slides are configured to allow the flange turning rollers to move from a first position to a second position as the rotor plate is rotating.

The flange turning rollers are positioned so that when the spiral pipe is placed on the mandrel, the flange turning rollers are located on the inner diameter of the spiral pipe. As the machine operates, and the flange turning rollers are moved via the slides from their first position to their second position, the flange turning rollers move radially from the inner diameter of the spiral pipe to an outer diameter. As the flange turning rollers move from the inner diameter of the spiral pipe to an outer diameter, the spiral pipe is deformed against the jaws by the flange turning rollers. In this way, an integrated flange is formed on the spiral pipe.

While the above-identified drawing figures set forth one embodiment of the invention, other embodiments are also contemplated, as noted in the discussion. In all cases, this disclosure presents the invention by way of representation and not limitation. It should be understood that numerous other modifications and embodiments can be devised by those skilled in the art which fall within the scope and spirit of the principals of this invention. The figures may not be drawn to scale. Like reference numbers have been used throughout the figures to denote like parts.

DETAILED DESCRIPTION

Figure 1A:
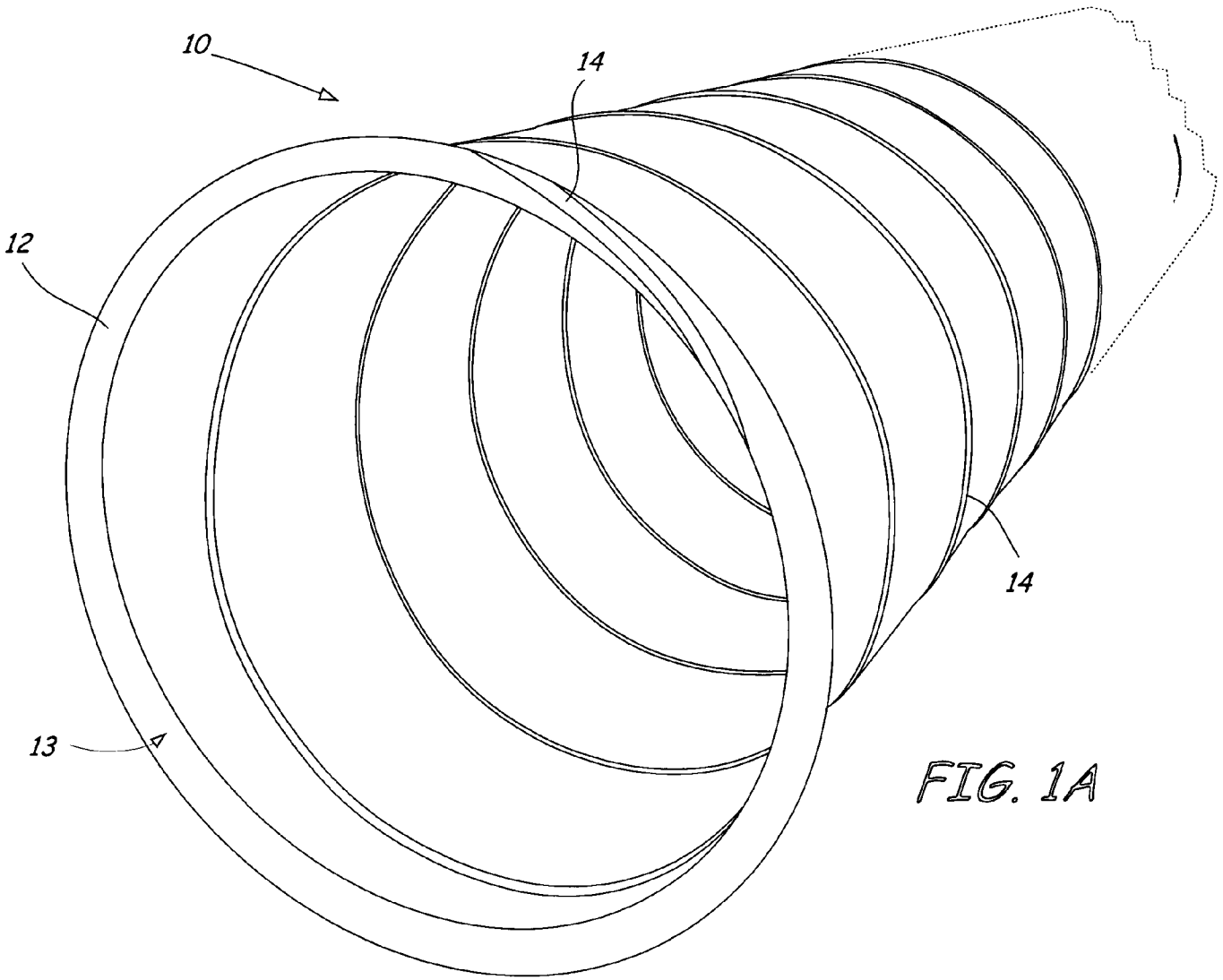
FIG. 1A is a perspective view of a spiral pipe having an integrated flange.

FIG. 1A is a perspective view of a spiral pipe 10 having a radial flange 12 on an end portion 13 thereof. Spiral pipe 10 further comprises a seam 14 which extends helically along the length of the pipe 10, including at the flange 12. The spiral pipe 10 is formed from a coil of metal sheeting wound into a cylindrical shape and joined edge-to-edge at the seam 14. As such, the seam 14 typically comprises a four ply spiral lock seam.

Figure 1B:
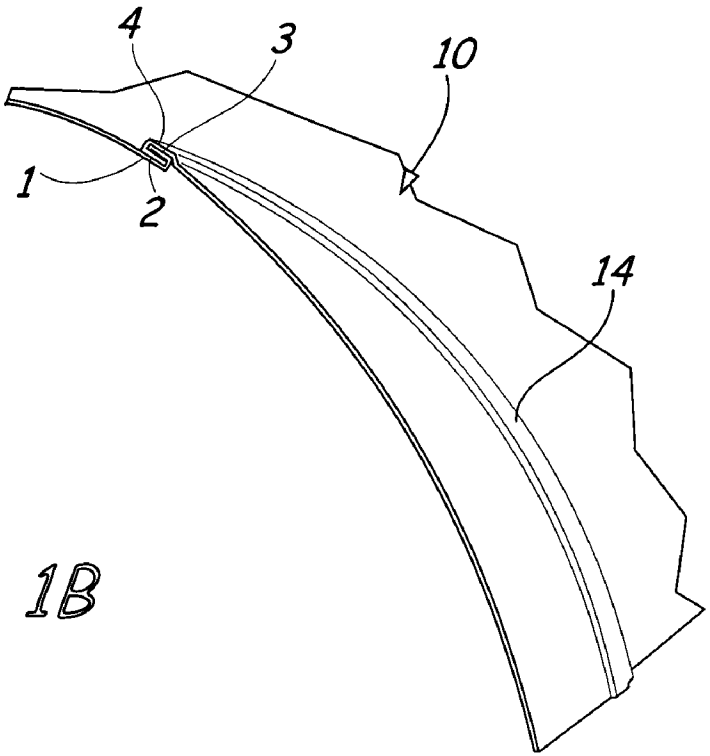
FIG. 1B is an enlarged perspective view of a 4-ply seam of a spiral pipe.

FIG. 1B is an enlarged perspective view of the seam 14 of the spiral pipe 10. The seam 14 comprises a first layer of metal sheeting 1, a second large of metal sheeting 2, a third layer of metal sheeting 3, and a fourth layer of metal sheeting 4. The seam 14 is formed by interconnecting bent first and third layers 1, 3 (from the longitudinal edge of the metal sheeting) with bent second and fourth layers 2, 4 (from an adjacent longitudinal edge of the metal sheeting) as shown. In other words, the spiral pipe 10 is four layers of metal sheeting material thick along the length of the seam 14, including the portion of the seam 14 on the flange 12.

In the past, it was extremely difficult to form a radial flange 12 on a end of a spiral pipe 10 due to the four ply seam 14. Specifically, when attempting to form the flange 12, the pipe 10 would crimp or break, commonly along the location of the four ply seam 14. In addition, when deformed to form the flange 12, the seam 14 may separate or otherwise make the pipe 10 unsuitable for use.

According to the present invention, the steel pipe 10 and integrated flange 12 are formed in such a way that the flange 12 is formed around the entire diameter of the spiral pipe 10, even at the location of the four ply seam 14. When forming the flange 12, care is taken to ensure that the location of the seam 14 does not affect the formation of the flange 12. In this way, the spiral seam 14 and integrated flange 12 result in a spiral pipe 10 which is neither crimped nor destroyed at the location of the seam 14 or anywhere along the pipe 10.

Figure 2:
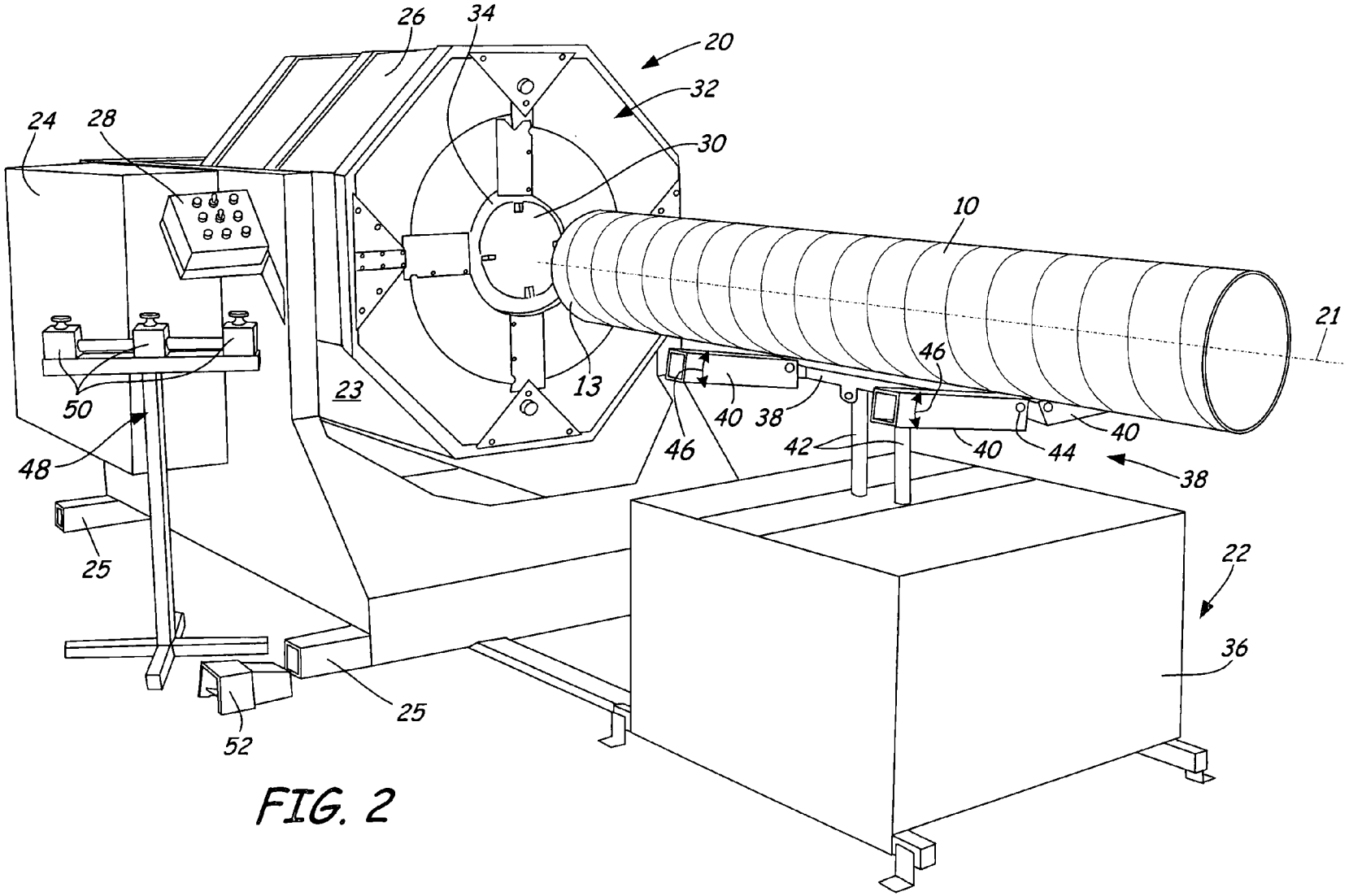
FIG. 2 is a perspective view of a flange turning machine and cradle for turning a flange on the spiral pipe.

FIG. 2 is a perspective view of a flange turning machine and pipe cradle for use with the present invention. Shown in FIG. 2 is a flange forming machine 20, a spiral pipe 10 having a central axis 21, (prior to a seam being formed on the end portion 13 thereof), and a spiral pipe cradle 22. The flange forming machine 20 comprises a housing 23, a motor housing 24, a base 25, a removable cover 26, and a control panel 28. The machine 20 sits on the base 25, while the housing 23 forms a cover around the machine 20. Similarly, the motor housing 24 shields the motor used to power the flange forming machine 20. In addition, the removable cover 26 is located adjacent a top portion of the motor housing 24, and allows access to the inner workings of the flange forming machine 20, such as for maintenance and repair.

On the front of the flange forming machine 20 is a round mandrel 30, a system of movable jaws 32, and an annular aperture 34 for receiving the end portion 13 of the spiral wound pipe 10. The aperture 34 is formed between the mandrel 30 and the jaws 32 when the jaws 32 are in an open position. The aperture 34 provides a location for inserting the spiral pipe 10 into the machine 20.

The cradle 22 comprises a cradle housing 36 as well as a cradle platform 38. The cradle platform 38 comprises one or more pairs of cradle arms 40. The cradle platform 38 is movable in a vertical direction by movement of rods 42 relative to the cradle housing 36. In this way, the spiral pipe 10 can be lifted or lowered on the cradle 22 so that the end portion 13 of the pipe 10 is positioned to easily fit in the aperture 34 created between the mandrel 30 and open jaws 32 of the flange forming machine 20. Any suitable mechanism may be used to raise or lower the cradle platform 38, such as a motor system located in the housing 36 of the cradle 22, or manually adjustable means.

In addition to being moveable in the vertical direction, the individual arms 40 of the cradle platform 38 are configured to be adjustable. The arms 40 are adjustable by rotating and fixing them about a pivot point 44 where each of the arms 40 attach to the cradle platform 38. In this way, the arms 40 can be rotated in the direction of arrows 46. By rotating the arms 40, the cradle platform 38 can be adjusted to accommodate spiral pipes 10 of varying diameters. Specifically, the arms 40 can be rotated upwardly to accommodate a smaller pipe diameter and can be rotated downwardly to accommodate a larger diameter pipe. Similarly, the arms 40 can be rotated downwardly until the cradle platform 38 is generally flat to more easily load a length spiral pipe 10 onto the cradle 22.

The control panel 28 on the machine 20 is configured to control the operations of the machine, and may optionally control operation of the cradle 22. The flange forming machine 20 can be programmed using any suitable programming source, and may use any suitable controller, such as an Allen Bradley controller available from Rockwell Automation of Milwaukee, Wis. The controller 28 can be configured to fully automate the machine 20 and cradle 22.

For instance, the controller 28 may be programmed to control the cradle 22 for several different diameters of spiral pipe 10. Based on the diameter of spiral pipe 10 inputted into the controller 28, the controller 28 may automatically adjust the vertical height of the cradle platform 38 to ensure that the spiral pipe 10 is located at a height which correspondences to the height of the mandrel 30. Automatically adjusting the height of the cradle platform 38 eases the insertion of the end portion 13 of the spiral pipe 10 into the flange turning machine 20 for flange formation. Once raised to the appropriate height on the cradle 22, an operator may simply slide or roll the pipe 10 forward in to the aperture 34 (to the left as viewed in FIG. 2). At the same time, the controller 28 may control the individual arms 40 so that they are rotated either upwardly or downwardly based on the diameter of the spiral pipe 10 being processed. In this way, the controller 28 ensures that the arms 40 are adjusted so that the length of spiral pipe 10 is most securely held in and supported by the arms 40 of the cradle 22.

The control 28 may further be used to control the flange forming machine 20 in connection with an operator station 48 having input mechanisms such as buttons 50 or a foot peddle 52. The operator station 48 may be designed in any suitable manner, and may include three separate or actuator buttons 50 to ensure a high level of safety to any operator operating the machine 20. The buttons 50 on the operator station 48 may be configured to require that two buttons be pressed simultaneously to begin operation of the flange forming machine 20. In this way, both of the operator's hands are required at the operator station 48 to initiate machine operation, thus ensuring the operator's hands are located well away from any potentially dangerous moving parts of the flange forming machine 20. Similarly, the foot peddle 52 may be configured to operate the jaw system 32 on the machine 20. Once again, the foot peddle 52 can be located in such a way as to ensure operator safety during operation of the machine 20.

Figure 3:
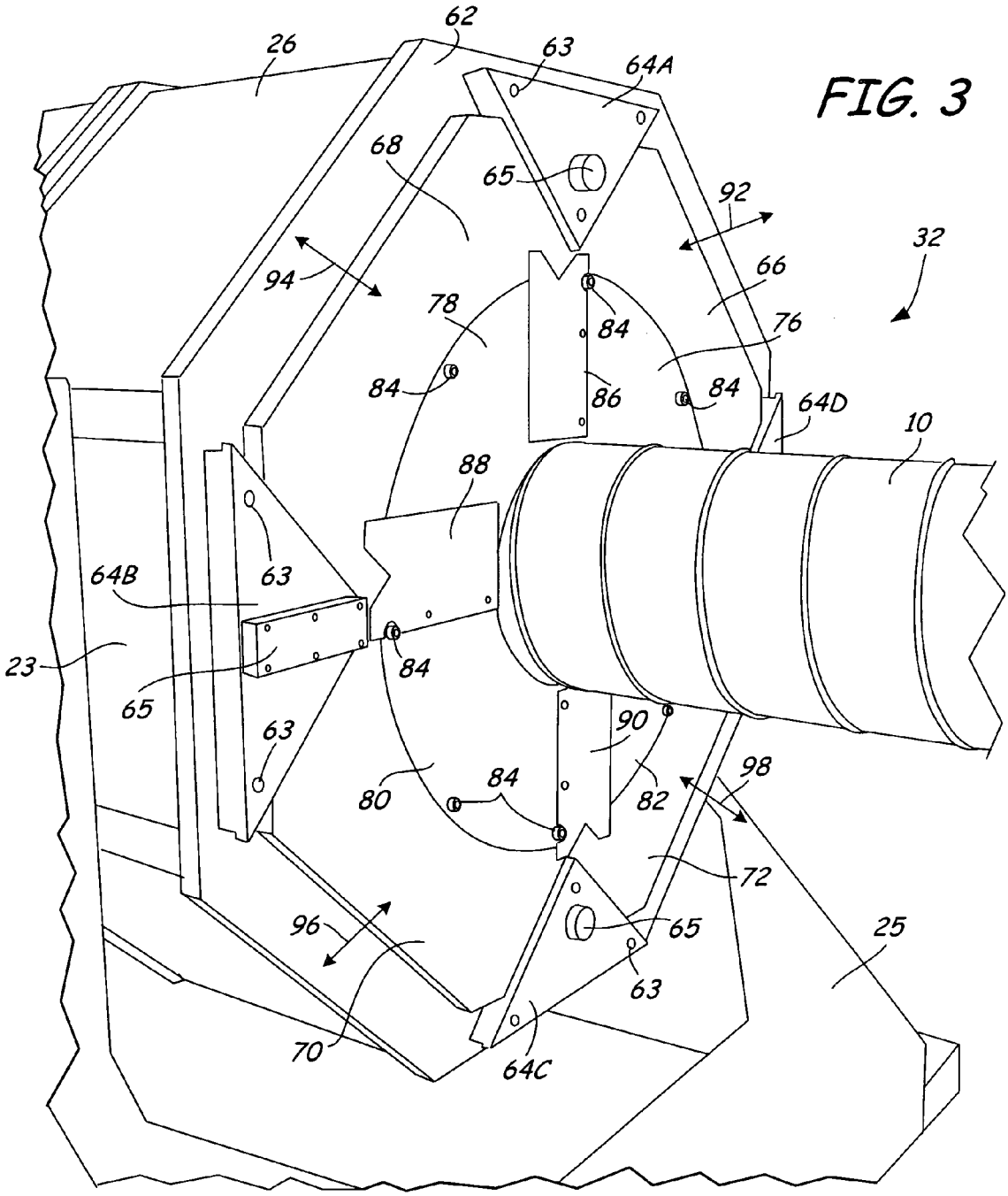
FIG. 3 is a perspective view of the flange turning machine having a spiral pipe with no flange inserted into the machine, with the spiral pipe inserted for flanging.

FIG. 3 is a perspective view of a portion of the flange turning machine 20 showing a length of spiral pipe 10 inserted therein. FIG. 3 illustrates a portion of the removable cover 26, housing 23, and base 25 upon which the machine 20 stands. As viewed in FIG. 3, the front face of the machine 20 comprises a base plate 62 and four slides 64A-D. The four slides 64 are connected to the base plate 62 using any suitable manner, such as fasteners 63 and a bracket 65.

Located between each of the slides 64A-D is a first jaw 66, second jaw 68, third jaw 70, and fourth jaw 72. Associated with the first jaw 66 is a first jaw plate 76, associated with the second jaw plate is a second jaw plate 78, associated with the third jaw 70 is a third jaw plate 80, and associated with the fourth jaw 72 is a fourth jaw plate 82. Each of the jaw plates 76-82 is attached to its corresponding jaw 66-72 using suitable fasteners, such as bolts 84. The first jaw plate 76 has an associated jaw plate shield 86, similarly, the second jaw plate 78 has a second jaw plate shield 88 and the third jaw plate 80 has a third jaw plate shield 90. Lastly, the fourth jaw plate 82 has a fourth jaw plate shield 92. (See FIG. 4).

Each of the jaws 66-72 is configured to be movable radially along the slides 64A-D. More specifically, the first jaw 66 is movable in a direction indicated by arrow 92 between first slide 64A and fourth slide 64D. Similarly, second jaw 68 is configured to move between first slide 64A and second slide 64B in the direction of arrow 94. Third jaw 70 is configured to move between second slide 64B and third slide 64C in the direction of arrow 96. Lastly, fourth jaw 72 is configured to move between third slide 64C and fourth slide 64D in the direction of arrows 98.

The first jaw plate 76 has an arcuate jaw edge 76*a* for engaging an outer surface of the spiral pipe. Similarly, the second jaw plate 78 has an arcuate jaw edge 78*a*, the third jaw plate 80 has an arcuate jaw edge 80*a*, and fourth jaw plate 82 has an arcuate jaw edge 82*a*. Second jaw plate 78 is further configured with a groove 174 (visible in FIGS. 5,6, 10A-10B), which corresponds to the location of the four ply seam 14 of a spiral pipe 10 when it is properly aligned in the machine 20. The first-fourth jaws 66-72 can be opened and closed along the slides 64A-D so that the associated first-fourth jaw plates 76-82 can be opened and closed to selectively engage the outer surface of the spiral pipe 10 via arcuate jaw edges 78*a*-82*a*. The groove 174 on second jaw plate 78 ensures the jaw plates close about the spiral pipe 10 to hold it against the mandrel 30 even at the seam 14. The jaw system 32 may be powered using any suitable method, such as by mechanical linkages or via hydraulic or pneumatic cylinders. As viewed in FIG. 3, the jaw system 32 is in a closed position.

Each of the jaws plates 76-82 are configured to be removable from the flange forming machine 20. In this manner, jaw plates 76-82 having different sized arcuate jaw edges 78*a*-82*a* to fit different diameters of pipe 10 may be used on the machine 20. To increase the ease with which the jaw plates 76-82 can be removed and replaced from the machine 20, each of the jaw plates 76-82 are connected to its respective jaw 66-72 by only two fasteners, such as bolts 84. Thus, by removing the bolts 84, different size jaw plates 76-82 can be attached to their corresponding jaws 66-72. This ensures that the machine 20 can easily accommodate a variety of spiral pipe diameters.

Figure 4:
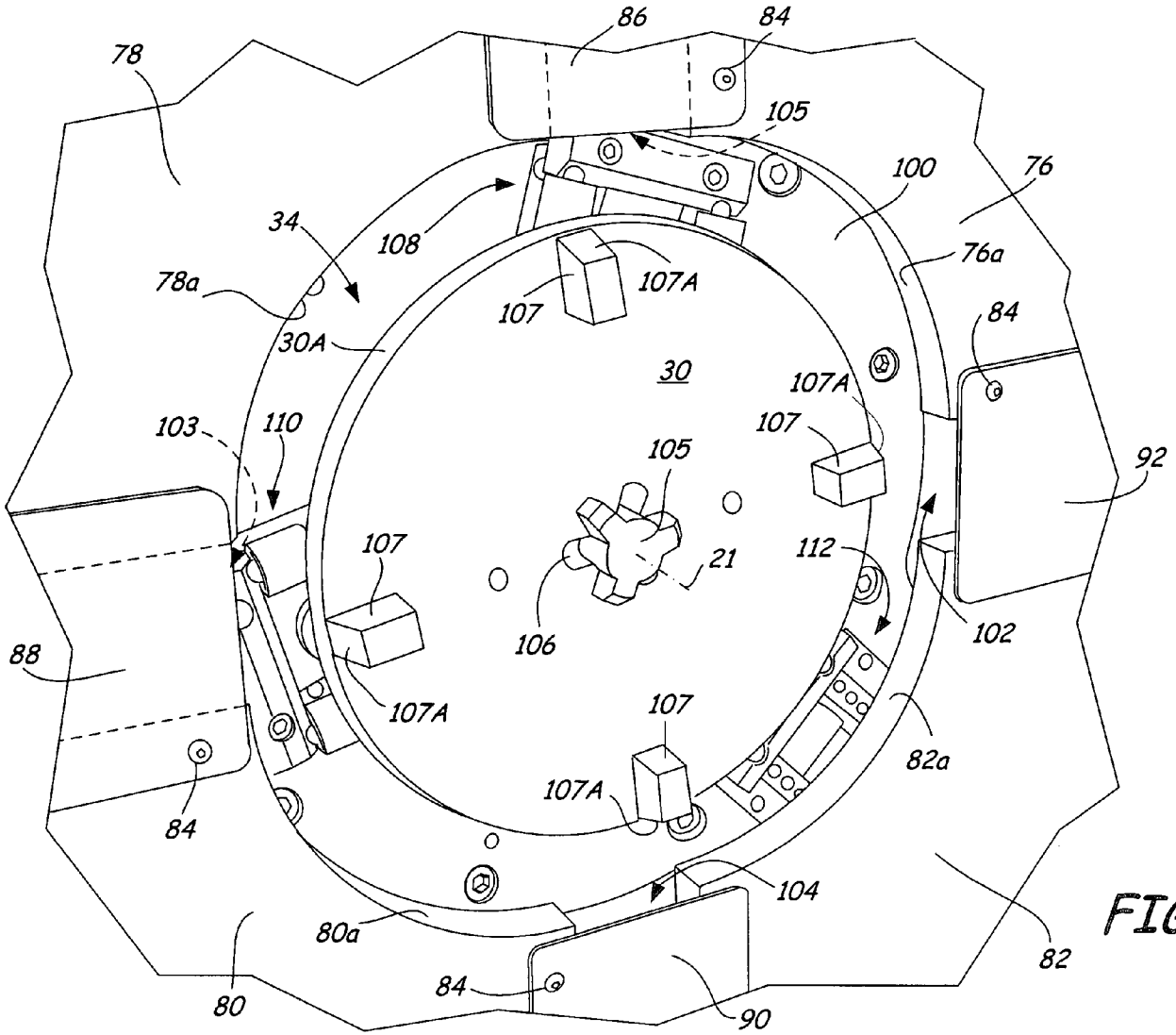
FIG. 4 is a perspective view of a portion of the flange turning machine showing the mandrel and the jaws in an open position without the spiral pipe inserted.

FIG. 4 is a perspective view of a portion of the flange turning machine 20 showing the jaw system 32 when it is in an open position. Visible in FIG. 4 is the mandrel 30, four jaw plates 76-82, four jaw plate shields 86-92, and bolts 84. When in the open position, each jaw plate 76-82 is pulled back radially from the mandrel 30 (and central axis 21) to form the annular aperture 34 between the mandrel 30 and the jaw plates 76-82. In addition to being radially remote from the mandrel 30, each jaw plate 76-82 becomes separated from the adjacent jaw plate.

More specifically, a gap 102 is formed between the first jaw plates 76 and the fourth jaw plate 82. Similarly, a gap 104 is created between the third jaw plate 80 and forth jaw plate 82. The shields 86-92 are sized to cover the gaps formed between the jaw plates 76-82 when the jaw plates 76-82 are in the open position.

The shields 86-92 serve as both as a safety and a guiding mechanism. For instance, the fourth jaw plate shield 92 that ensures an operator's fingers do not get placed between the two jaw plates 76, 82 as the jaw plates 76, 82 close and move toward each other. Similarly, the jaw plate shield 92 assists in locating a spiral pipe 10 within the aperture 34 created when the jaw plates 76-82 are in their open position. Gaps 103 and 105 (shown in dashed lines in FIG. 4) are likewise formed between the first jaw plate 76 and second jaw plate 78, and between the second jaw plate 78 and third jaw plate 80, respectively. Forming the jaw plate shields 86-92 to be slightly larger than the gaps 102-105 helps with inserting the pipe 10 into the machine while providing a safety feature which helps prevent anything from being placed between the jaw plates 76-82 as the plates 76-82 close.

Also shown in FIG. 4 is a rotor plate 100, mandrel clamp 105, mandrel clamp aperture 106, and mandrel guides 107. Visible through the aperture 34 on the rotor plate 100 is a first flange roller mechanism 108, a second flange roller mechanism 110, and a third flange roller mechanism 112.

The mandrel guides 107 are affixed to the mandrel 30. The mandrel guides 107 function to assist in positioning the spiral pipe 10 as it is being inserted into the annular aperture 34 of the flange rolling machine 20. As such, the mandrel guides 107 have an angle side which meets an outer circumferential edge of the mandrel 30. Similarly, there are four mandrel guides 107 located equal distance along the outer edge 30A of the mandrel 30. Spacing the mandrel guides 107 at four locations around the outer edge 30A of the mandrel 30, as well as making each of the guides 107 with an angled side 107A, assists a user in centering a spiral pipe over the mandrel 30 so that the pipe is properly positioned for the flanging process.

The rotor plate 100 is located behind the aperture 34, and behind the jaw plates 76-82. Mounted on the rotor plate 100 are the three flange roller mechanisms 108-112. As described fully below, the flange roller mechanisms 108-112 are configured to work the end portion 13 of the spiral pipe 10 to form the flange 12 on the spiral pipe 10.

The mandrel clamp 105 allows the mandrel 30 to be removably mounted on the machine 20. Just as the jaw plates 76-82 come in a variety of sizes to accommodate different diameter of spiral pipe, the mandrel 30 likewise comes in a variety of sizes (e.g. different diameters defined by outer edge 30A) to fit different inner diameters spiral pipe. As such, the mandrel 30 is easily removed and replaced in the machine. To do so, the mandrel 30 is rotated until the clamp aperture 106 aligns with the clamp 105, allowing the mandrel 30 to slide over the clamp 105 and be removed from the machine 20. Other means for removably mounting the mandrel 30 to the machine 20 are also contemplated.

Figure 5:
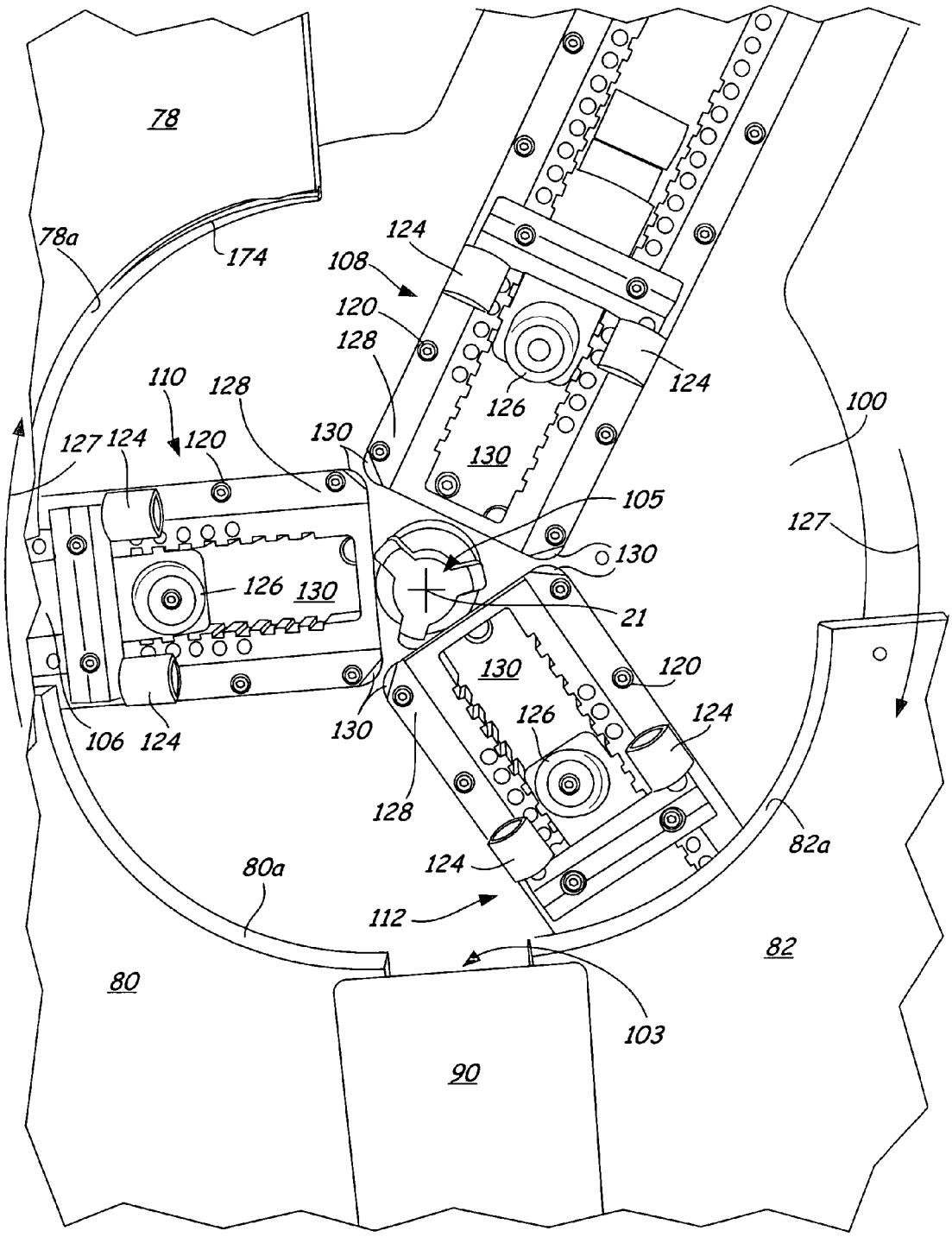
FIG. 5 is a front view of a portion of the flange turning machine with the mandrel removed and one of the jaws removed to show the rotor plate and flange turning rollers.

FIG. 5 is a front view of a portion of the flange turning machine 20 having the mandrel 30 removed and having jaw plate 82 removed to more clearly illustrate the flange roller mechanisms 108-112. Shown in FIG. 5 are portions of the second jaw plate 78 having seam accommodating grove 174, third jaw plate 80, and fourth jaw plate 82. Also visible is the third jaw plate shield 90, rotor plate 100, and mandrel clamp 105. Shown on the rotor plate 100 is the first flange roller mechanism 108, second flange roller mechanism 110, and third flange roller mechanism 112. Each of the flange roller mechanisms is integrally connected to the rotor plate 100 using any suitable manner, such as by using suitable fasteners such as bolts 120.

The flange roller mechanisms 108-112 are spaced circumferentially about the center axis 21 and are preferably located equal distances from each other about 120° apart. Locating the flange roller mechanisms 108-112 this way ensures the flange roller mechanism 108-112 operates symmetrically and thus as smoothly as possible. This symmetry appears to ensure that the flange created by the flange roller mechanism 108-112 is formed evenly, and without crimping or otherwise adversely affecting the spiral pipe, especially along that multi-ply portion of the seam 14.

Each flange roller mechanism 108-112 consists of two bushings 124 and a roller 126. To create the flange, the rotor plate 100 is rotated in a clock-wise direction about the central axis 21 (in direction of arrows 127) relative to the mandrel and jaw plates which do not rotate, causing the roller mechanisms 108-112 to likewise rotate. The rollers 126 are used to create the flange, while the bushings 124 guide the rollers 126 as the rotor plate 100 is rotating. Further, each flange roller mechanism 108-112 is located on a slide 128. The slide 128 is located in a corresponding slide aperture 130 of the roller plate 100. As the rotor plate 100 is rotating, the flange roller mechanisms 108-112 are moved radially along the slides 128. As shown in FIG. 5, the slides 128 are all in a start position.

Figure 6:
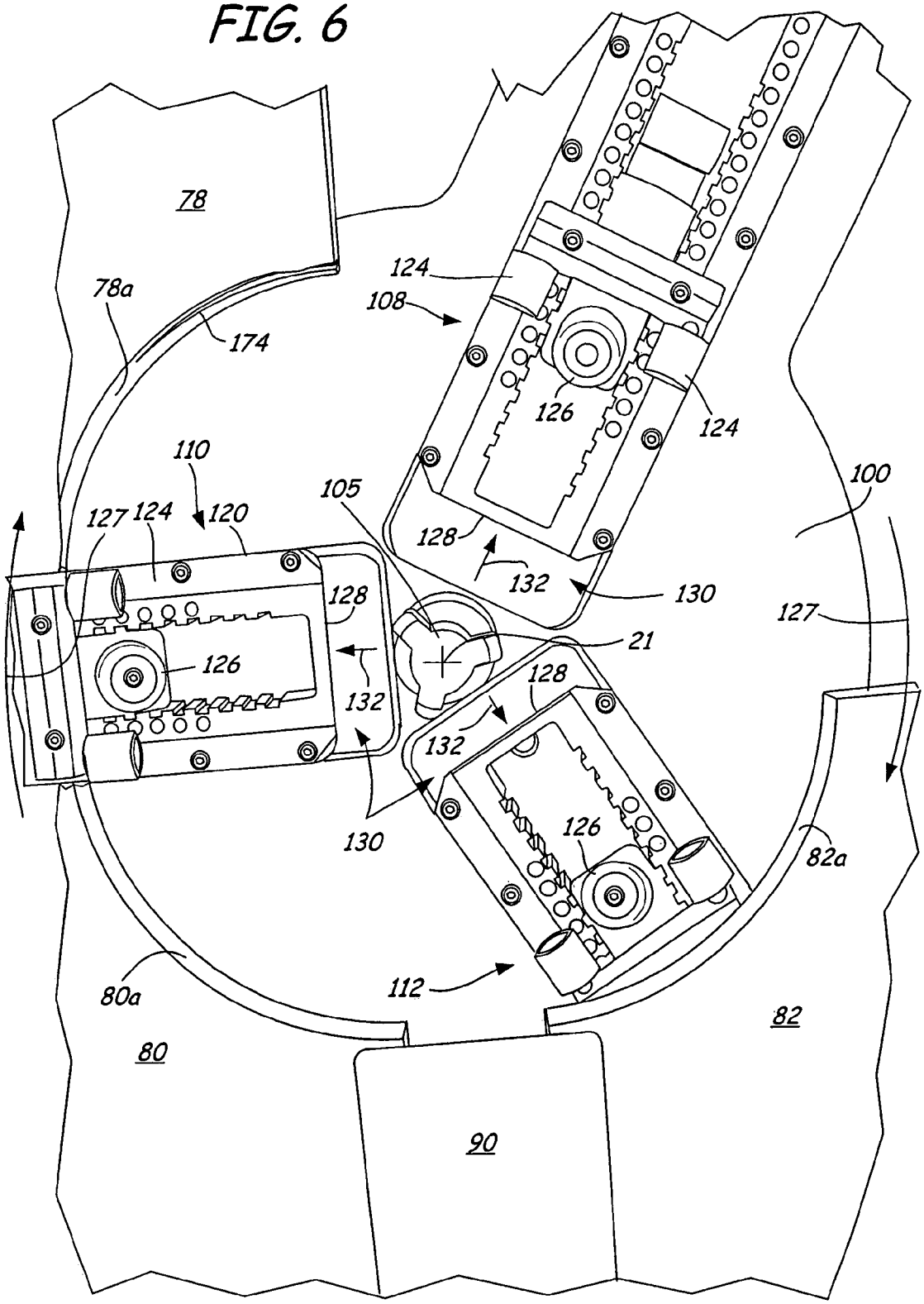
FIG. 6 is a front view of a portion of the flange turning machine with the mandrel removed illustrating the movement of the flange turning rollers.

FIG. 6 is a diagrammatic illustration which illustrates the movement of the slides 128. As compared to FIG. 5, the slides 128 in FIG. 6 are shown in an end position, where slides 128 have been moved radially outwardly during the flange forming process. In moving from the start position (FIG. 5) to end position (FIG. 6), the slides 128 move along the slide apertures 130 in the direction of arrow 132, relative to the central axis 21.

Figure 7:
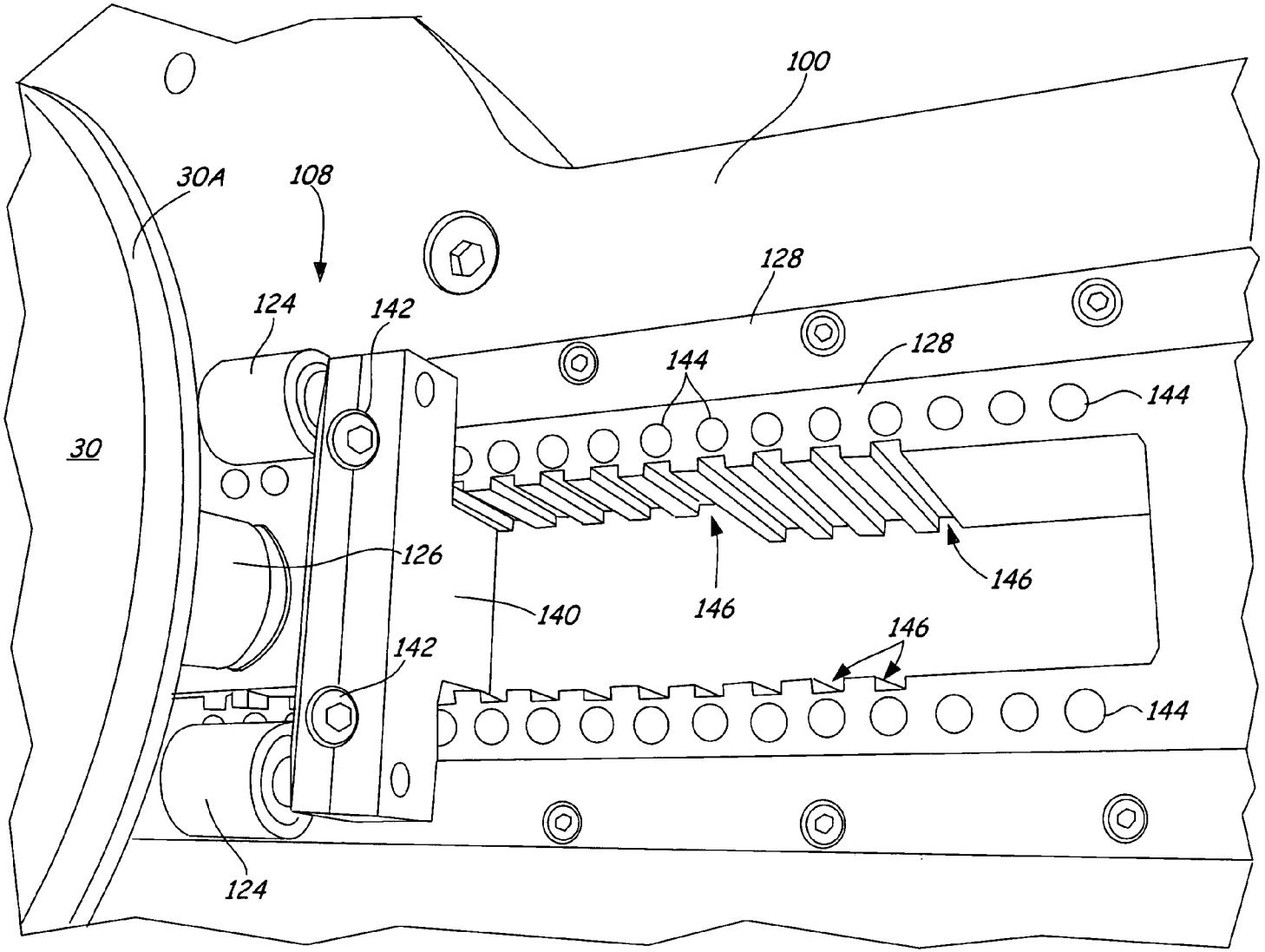
FIG. 7 is an enlarged perspective view of a portion of the flange turning machine showing the flange turning roller in more detail, with the jaws removed for clarity of illustration.

FIG. 7 illustrates a method by which the flange roller mechanism 108 can be adjusted to accommodate various diameters of spiral pipe 10. Shown in FIG. 7 is a portion of the rotor 100, one of the slides 128, its bushings 124, and its roller 126. The roller 126 and bushings 124 are mounted on the slide 128 using a mounting block 140. The mounting block 140 attaches to the slide 128 using suitable fasteners such as two bolts 142. Also on the slide 128 are several bolt holes 144 and notches 146 configured to allow the mounting block 140 to be located at various points along the length of the slide 128. The bolt holes 144 and notches 146 allow for radial adjustability of the slide 128. In this way, the location of the rotor 126 can be adjusted to ensure it matches the desired diameter of the spiral pipe 10 on which a flange is to be formed.

It may be possible to develop a code on the slide 128 to increase the ease with which the mounting block 140 is located along the length of the slide 128. When each slide 128 is so coded, it increases the ease with which the operator is able to make the necessary adjustments to the mounting block 140. For instance, each of the bolt holes 144 maybe labeled with the corresponding diameter size of spiral pipe to which they correspond for positioning the slide 128.

Figure 8:
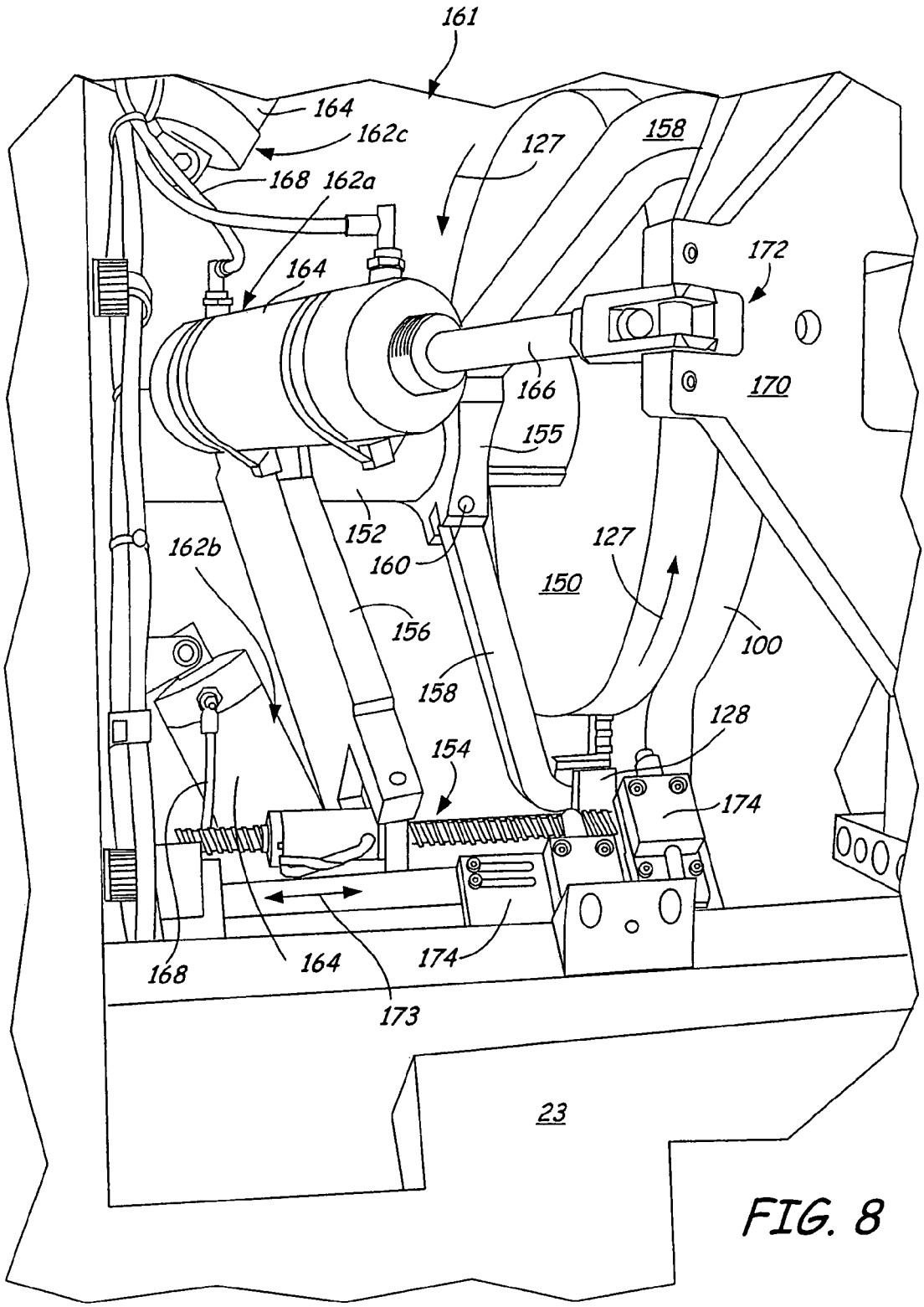
FIG. 8 is a perspective view of a portion of the flange turning machine illustrating the rear side of the rotor plate.

FIG. 8 is a perspective view of the mechanical portion of the machine located inside the housing. Shown in FIG. 8 is the back of the rotor plate 100 (the side opposite that to which the flange forming mechanisms are mounted) a rotor flange 150, and a center shaft 152 (which is coaxial with the center axis 21). The center shaft 152 is connected to a screw drive mechanism 154 using a coupling 156. Visible in FIG. 8 are two of three radially disposed slide moving arms 158, which each connect to a center shaft slide 155 on the center shaft 152 at a pivot 160. Also visible in FIG. 8 are portions of the housing 23, and various mounting blocks 174 which connect various mechanisms to the housing and frame 22.

FIG. 8 also shows a jaw cylinder system 161 as the mechanism for opening and closing the holding jaws. Shown in FIG. 8 are three jaw cylinder assemblies 162*a-c*. Though only three jaw cylinder assemblies 162*a-c* are shown in FIG. 8, the machine comprises four cylinder assemblies, one associated with each jaw. Each jaw cylinder assembly is similar. For example, the jaw cylinder assembly 162*a* comprises a cylinder 164, telescoping cylinder rod 166, and inlet and outlet hoses 168. Each cylinder rod 166 is pivotally connected to a jaw moving plate 170 at a pivoting connection 172.

The jaw cylinder system 161 is used to open and close the jaws. To do so, each cylinder 164 is activated using any suitable means, such as supplying air or hydraulic fluid using hoses 168. Once a cylinder 164 is activated, its respective cylinder rod 166 extends or retracts, moving its respective jaw plate mount 170 at a pivot 172. In this way, the four jaw plates can be opened and closed about a length of spiral pipe. Such jaw cylinder systems 161 are known in the art.

The rotor plate 100 is connected to the rotor flange 150, which is in turn connected to the center shaft 152. The center shaft 152 is rotatably driven using any suitable driving force, such as an electric motor (not shown), so that the center shaft 152 is rotated in a clock-wise direction as viewed from the front of the machine 20. As the center shaft 152 is rotated in a clock-wise direction, the rotor flange 150 and rotor plate 100 are likewise rotated in a clock-wise direction (again, as arrows 127 in FIGS. 5, 6, and 8 indicate). At the same time the rotor plate 100 is being rotated, the screw drive system 154 is engage to drive the slide 155 forward. To do so, the screw drive system 154 is operably connected to the center shaft slide 155 at the coupling 156. Thus, as the screw drive system 154 is actuated, the coupling 156 transfers the linear movement of the screw drive system 154 (e.g., arrows 173) to the center shaft slide 155.

As the slide 155 is driven forward, the arms 158 pivot at their pivot points 160. The arm 158 is connected to a respective one of the slides 128 which hold the flange roller mechanisms 108-112. As the arms 158 are driven forward and pivot, the arms 158 move the roller slides 128 from their FIG. 5 start position (within the inner diameter of the end portion 13 of the spiral pipe) radially outward from the center of the rotor plate 100 toward their end FIG. 6 position, bending the spiral pipe outwardly and forming a flange in the process. As the arms 158 move the roller slides 128 outwardly, the rollers 126 on the flange roller mechanisms 108-112 engage the inner diameter of the spiral pipe, and roll it against the back of the jaw plates to form a flange.

Figure 9:
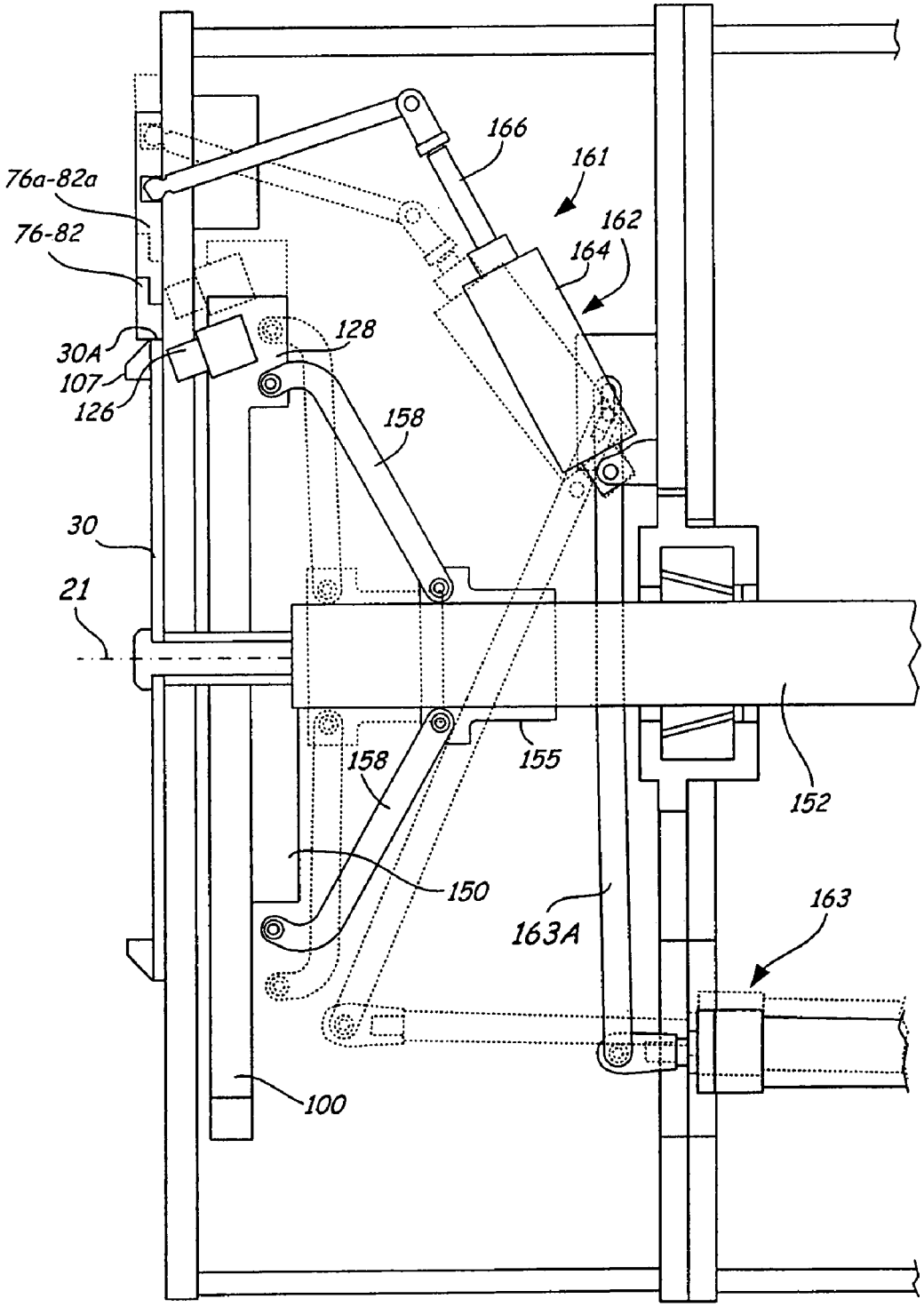
FIG. 9 is a side view of a portion of the flange turning machine illustrating two positions of the components of the flange turning machine.

FIG. 9 is a top plan view of a portion of the flange turning machine 20 for illustrating the action of the jaws and the action of the flange rollers. Shown in FIG. 9 is the center shaft 152, center shaft slide 155, arm 158, and roller slide 128. Located on the roller slide 128 is the roller 126. Also shown is the mandrel 30, jaw plate 76-82, jaw cylinder system 161, comprising one of jaw cylinder assembly 162 having its cylinder 164 and its cylinder rod 166. Lastly, the rotor plate 100 and rotor flange 150 are also visible. For simplicity and illustration, only one of the four jaw cylinder assemblies 162 is shown in FIG. 9. Similarly, only two of the three arms 158, and only one of the three rollers 126 is shown.

As illustrated, the jaw cylinder system 161 is configured to move from an open position (dashed lines) to a closed position (solid lines). When in the open position, the cylinder 164 is operated so that the rod 166 is extended. The jaw cylinder system 161 may further comprise a second rotational cylinder system 163. The second rotational cylinder is connected by a linkage 163A to the cylinder 164 and is used to properly position the cylinder to facilitate opening and closing the jaw plates 76-82.

The roller 126 is connected to the slide 128 as described above. In addition, the slide 128 is pivotally connected to the center shaft slide 155 via the arm 158. Actuation of the screw drive mechanism 154 causes the center shaft slide 155 to move along center shaft 152 from a rearward position to a forward position. In the rearward position, the roller 126 is located radially just within the circumferential edge 30A of the mandrel 30. When the center shaft slide 155 is advanced along the shaft 152 (to the left as viewed in FIG. 9), the arm 158 moves to its forward position, which in turn moves the slide 128 radially outward, and thus the roller 126 is moved radially outward as well (indicated by dashed lines). In doing so, the roller 126 engages the spiral pipe 10 to form a flange on the spiral pipe 10.

Figure 10B:
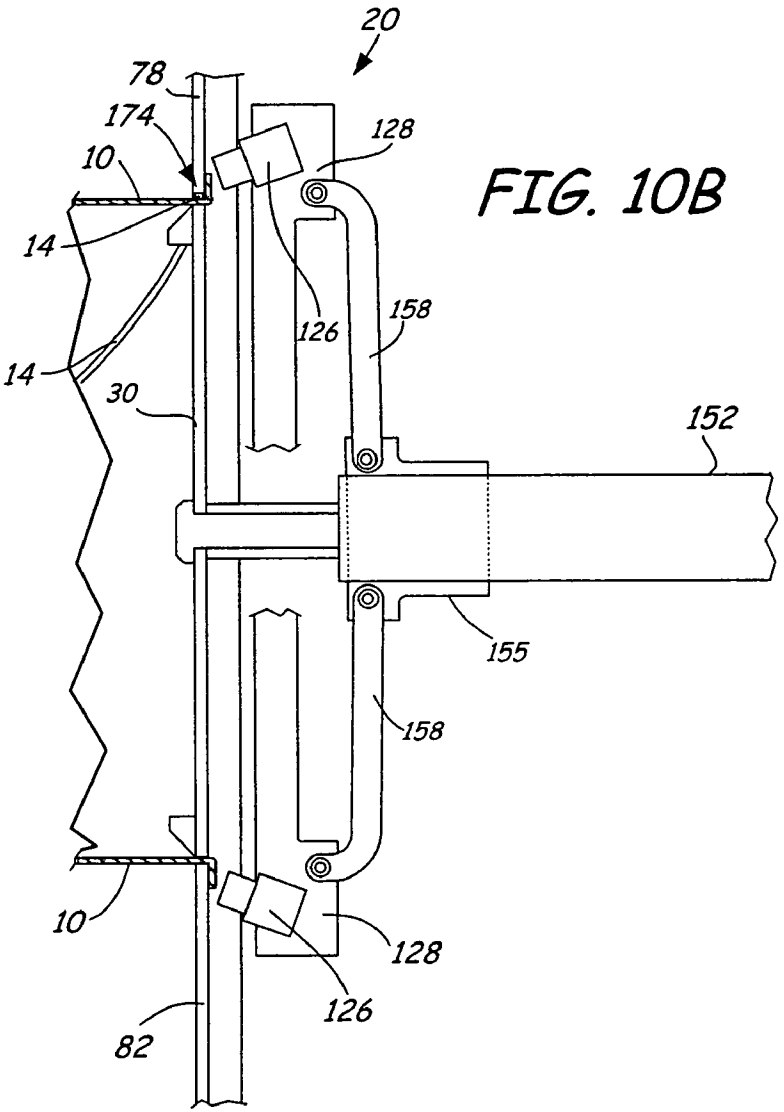
FIGS. 10A and 10B are side diagrammatic views of the flange turning machine illustrating how it operates to form an integrated flange on a spiral pipe.
Figure 10A:
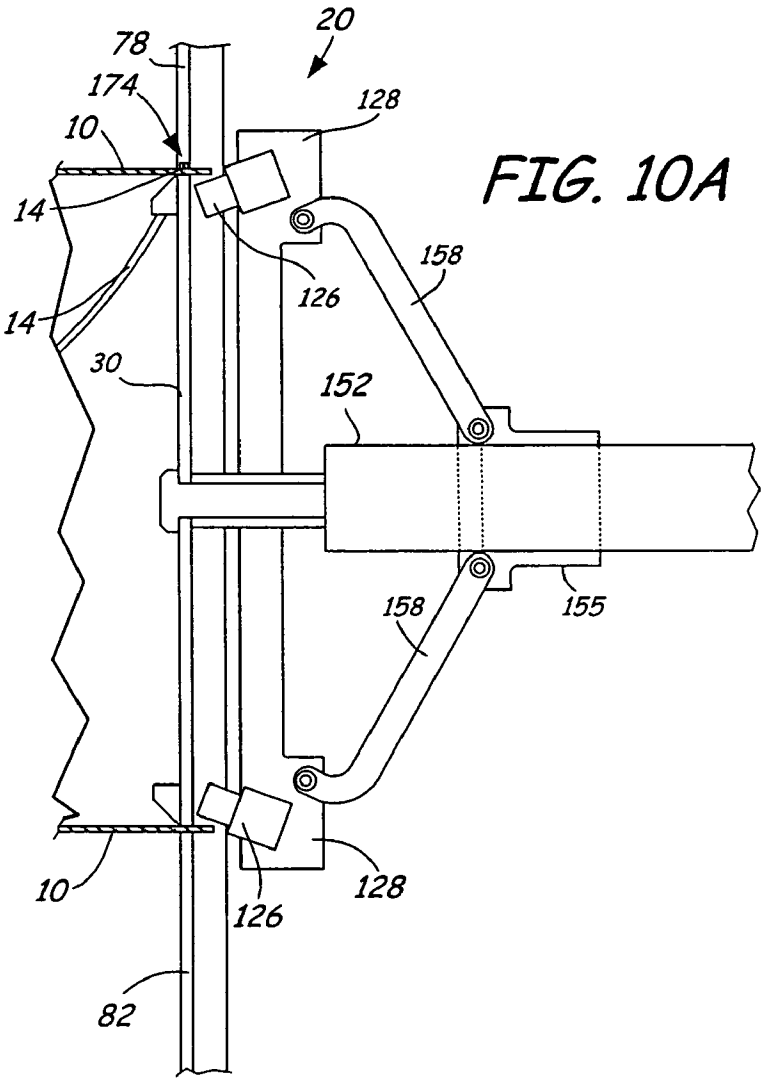

FIGS. 10A and 10B illustrate the formation of the flange more clearly. FIGS. 10A and 10B are simplified side perspective views illustrating the operation of the slides 128. Shown in FIG. 10A is the center shaft 152, the center shaft slide 155, arms 158, slides 128, and rollers 126. The rollers 126 are affixed to the slides 128, and the slides 128 are movable connected to the center shaft slide 155. Shown in FIG. 10A is the spiral pipe 10 placed into the machine 20 so that the end portion 13 of the spiral bound pipe 10 fits snugly against the mandrel 30 (in other words, the inner diameter of the spiral pipe fits closely over the outer diameter of the mandrel 30).

Also visible are two jaw plates 78, 82. Visible on the jaw plate 78 is the groove 174 configured to accommodate the seam 14 on the spiral bound pipe 10. In this way, the jaws 78, 82 are configured to close snugly about the spiral bound pipe 10, holding it against the mandrel 30 with minimal clearance, even at the seam 14. As is also shown in FIG. 10A the rollers 126 are located on the inside diameter of the spiral bound pipe 10.

FIG. 10B illustrates the position of the slides 128 and roller 126 after the machine 10 has been allowed to operate. During operation, the center shaft 152 is rotated, to spin the slides 128 and rollers 126 thereon, and the center shaft slide 155 is moved to a forward position. When in the forward position, the center shaft slide 155 and connecting arms 158 serve to move the slides and rollers 126 mounted thereon radially outwardly, from within an inner diameter of the spiral bound pipe 10 to an outer position. In doing so, the rollers 126 press a small length of the spiral bound pipe 10 against a back side of the jaw plates 78, 82. As the shaft 152 is rotating, the rollers 126 are likewise rotating. As the rotating rollers 126 move radially outwardly relative to the end portion of the spiral bound pipe 10, a flange 12 is created on the spiral pipe 10. The flange 12 is formed by deflecting (i.e. bending) the end portion 13 of the spiral pipe 10 against the jaw plates 78, 82, as the rollers 126 are forced outwardly. The groove 174 which accommodates the seam 14 of the spiral pipe 10 helps ensure the flange 12 is formed along the entire diameter of the end portion 13 of the spiral pipe 10 without crimping or otherwise damaging the spiral pipe 10.

Figure 11:
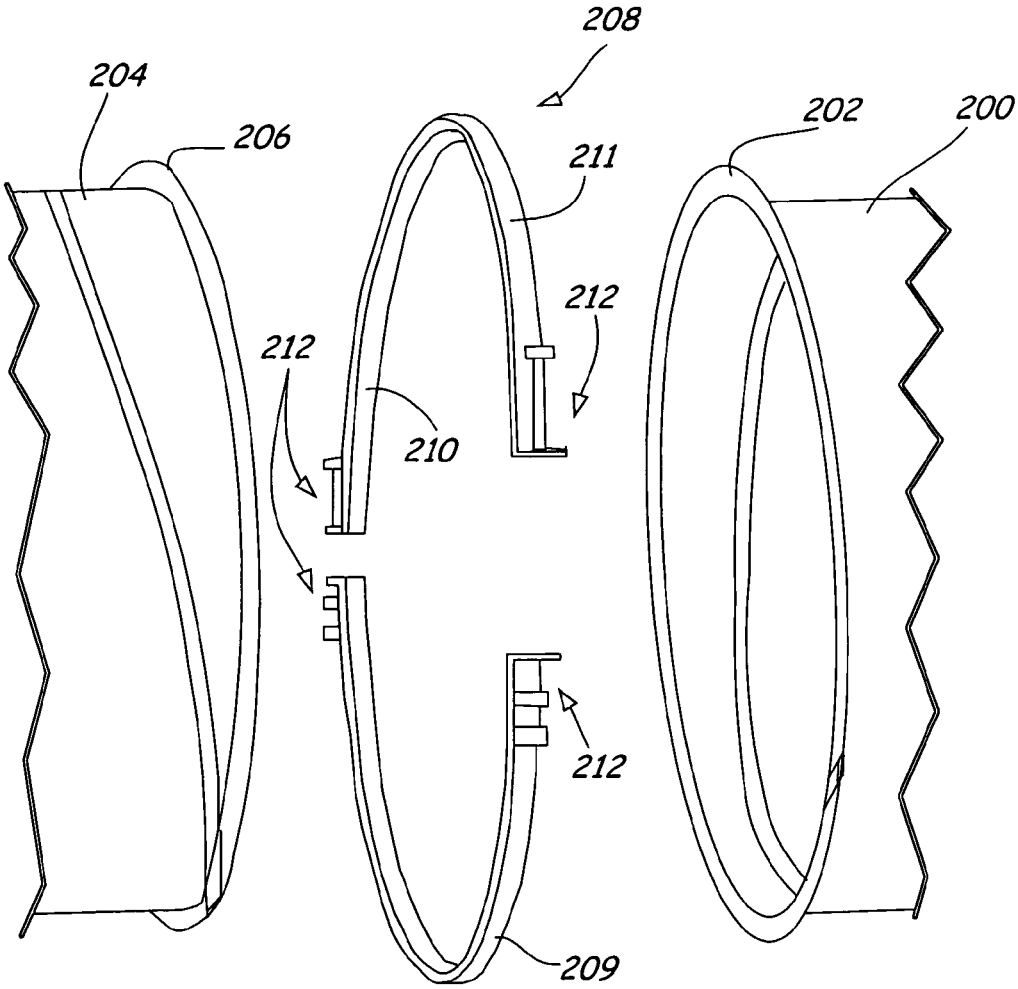
FIG. 11 is an exploded perspective view of two portions of spiral pipe connected using a barrel clamp.

FIG. 11 is an exploded perspective view illustrating the manner in which the present invention improves the ability to connect spiral pipe. Shown in FIG. 11 is a first length of spiral pipe 200 with an integrated flange 202, a second length of spiral pipe 204 with an integrated flange 206, and a barrel clamp 208. The barrel clamp 208 comprises a first section 209 and a second section 211. Each section 209, 211 of the barrel clamp 208 comprises a groove 210 and connection mechanisms 212.

A spiral pipe with an integrated flange greatly increases the ease with which two lengths of pipe can be interconnected. To do so, the integrated flanges 202, 206 of each length of spiral pipe 200, 204 are placed together. A gasket, seal, or adhesive layer may optionally be included on one or both of the integrated flanges 202, 206 to facilitate a sealed connection between the two lengths of pipe 200, 204. Next, the barrel clamp 208 is assembled so that the first section 209 and second section 211 are connected so that the groove 210 engages the flanges 202, 206. The barrel clamp 208 is then connected at the connection mechanisms 212 so that the barrel clamp 208 holds the two lengths of pipe 202, 206 together.

The connection mechanisms 212 may be any suitable mechanisms for interconnecting the sections 209, 211 of the barrel clamp. For instance, the connection mechanisms 212 may comprises a flange and a bore. To connect the sections 209, 211, the bores of each section are aligned and a bolt is inserted to hold the sections 209, 211 together.

This connection system greatly increases the speed and ease of installing duct work. Pipe to pipe connections become much easier to perform, and require less labor, fewer tools, and less space. Further, the barrel clamp 208 allows for the ducts to be disassembled and reassembled. Finally, particularly when a gasket is employed, leakage between the lengths of spiral pipe is greatly reduced.

Although the present invention has been described with reference to preferred embodiments, workers skilled in the art will recognize that changes may be made in form and detail without departing from the spirit and scope of the invention.

The invention claimed is:

1. A flange turning machine for creating a flange on a spiral pipe, the machine comprising:

a mandrel;

jaws configured to hold the spiral pipe against the mandrel;

a rotor configured to rotate;

a slide configured to move radially from a start position on the rotor to an end position on the rotor;

a central shaft slide configured to move from a rearward position to a forward position;

a slide moving arm configured to move the slide from the start position to the end position as the central shaft slide moves from the rearward position to the forward position; and a flange turning roller mounted on the slide, and configured to create the flange by deforming an end portion of the spiral pipe against the jaws as the rotor rotates and the slide moves from the start position to the end position.

2. The flange turning machine of claim 1 and further comprising a control system.

3. The flange turning machine of claim 1 wherein the jaws and mandrel are adjustable to accommodate spiral pipes of varying diameters.

4. The flange turning machine of claim 1 and further comprising a shaft upon which the rotor is mounted.

5. The flange turning machine of claim 1 and further comprising a motor for advancing the central shaft slide from the rearward position to the forward position.

6. The flange turning machine of claim 1 wherein the jaws comprise four jaws actuated in a direction perpendicular to a central axis of the spiral pipe.

7. The flange turning machine of claim 6 wherein the jaws are pneumatically actuated.

8. The flange turning machine of claim 1 and further comprising three flange turning rollers positioned about 120 degrees from each other.

9. The flange turning machine of claim 2 and further comprising a cradle for holding the spiral pipe, wherein the cradle is configured to be controlled by the control system.

10. A machine for flanging a spiral pipe, the machine comprising:

a mandrel;

jaws for holding the spiral pipe on the mandrel, wherein one of the jaws comprises a groove for accommodating a seam of the spiral pipe;

a rotor; and a roller located on the rotor, wherein the roller is movable in a direction generally perpendicular to a central axis of the spiral pipe.

11. The machine of claim 10 wherein the roller is moveably connected to the rotor via a slide.

12. The machine of claim 11 and further comprising three rollers, each roller separated from the other by about 120 degrees.

13. The machine of claim 10 wherein the jaws holding the pipe on the mandrel comprise a plurality of pneumatically actuated jaws.

14. The machine of claim 10 wherein the mandrel and jaws are removable to allow the machine to accommodate varying diameters of spiral pipe.

15. The machine of claim 14 and further comprising a control system for controlling a speed of the rotor based on the varying diameters of spiral pipe.

16. A machine for forming a flange on a spiral pipe, the machine comprising:

a mandrel;

jaws for holding the spiral pipe against the mandrel;

a rotor plate;

a center shaft for rotating the rotor plate;

a center shaft slide for providing a longitudinal force along the center shaft;

an arm for translating the longitudinal force into a radial force along the rotor plate; and a flange roller mechanism for forming the flange by rotating as the rotor rotates and moving radially in response to the radial force.

17. The machine of claim 16 and further comprising a control system for controlling a speed of the rotor based on a diameter of the spiral pipe.

18. The machine of claim 16 wherein the jaws and mandrel are adjustable to accommodate spiral pipe of varying diameters.

19. The machine of claim 16 wherein the jaws comprise a plurality of jaws actuated in a direction generally perpendicular to a longitudinal axis of the spiral pipe.

20. The machine of claim 19 wherein one of the plurality of jaws comprises a groove for accommodating a seam of the spiral pipe.

21. The machine of claim 16 and further comprising three flange roller mechanisms, each flange roller mechanism separated from the other by about 120 degrees.

22. The machine of claim 16 and further comprising a cradle for holding the spiral pipe.

23. A machine for forming an integrated flange on an end of a spiral pipe, the machine comprising:

a mandrel;

a plurality of jaw plates configured to hold the end of the spiral pipe against the mandrel, wherein one of the jaw plates comprises a groove to accommodate a seam of the spiral pipe;

a plurality of flange rollers configured to form the integrated flange by bending the end of the spiral pipe radially outward against a back of the jaw plates;

a rotor plate configured to rotate the flange rollers while forming the integrated flange; and a plurality of arms configured to move the flange rollers radially while forming the integrated flange.

24. The machine of claim 23, further comprising a central shaft slide for driving the arms.

25. The machine of claim 23, wherein the flange rollers form the integrated flange at an angle of approximately ninety degrees with respect to a central axis of the spiral pipe.

26. The machine of claim 25, wherein the flange rollers form the integrated flange such that the integrated flange includes a seam of the spiral pipe.

* * * * *